US012359883B2

(12) United States Patent
Wilmer

(10) Patent No.: US 12,359,883 B2
(45) Date of Patent: Jul. 15, 2025

(54) METHODS AND SYSTEMS FOR A HEAT EXCHANGER

(71) Applicant: Jeffrey A. Wilmer, Mesa, AZ (US)

(72) Inventor: Jeffrey A. Wilmer, Mesa, AZ (US)

( * ) Notice: Subject to any disclaimer, the term of this patent is extended or adjusted under 35 U.S.C. 154(b) by 0 days.

(21) Appl. No.: 17/832,275

(22) Filed: Jun. 3, 2022

(65) Prior Publication Data

US 2022/0390179 A1 Dec. 8, 2022

Related U.S. Application Data

(60) Provisional application No. 63/197,237, filed on Jun. 4, 2021.

(51) Int. Cl.

| | |
|---|---|
| ***F28D 7/00*** | (2006.01) |
| ***F28D 7/02*** | (2006.01) |
| ***F28F 27/02*** | (2006.01) |

(52) U.S. Cl.

CPC ..... *F28F 27/02* (2013.01); *F28D 7/028* (2013.01); *F28F 2210/02* (2013.01)

(58) Field of Classification Search

CPC ..... F28D 7/024; F28D 7/028; F28F 27/02
See application file for complete search history.

(56) References Cited

U.S. PATENT DOCUMENTS 752,994 A * 2/1904 McKee ..... A01J 9/04 165/75
908,465 A * 1/1909 Jett ..... B01D 3/14 202/175
1,946,118 A * 2/1934 Stockdale ..... F16L 5/00 285/123.1
2,074,551 A * 3/1937 Knight ..... B01J 19/30 261/154
2,492,407 A * 12/1949 Tomany ..... B01J 8/067 422/659

(Continued)

FOREIGN PATENT DOCUMENTS

| | | |
|---|---|---|
| EP | 3594554 | 1/2020 |
| GB | 913621 A * | 12/1962 |
| WO | 2011068035 | 6/2011 |

OTHER PUBLICATIONS

International Search Report and Written Opinion of the International Searching Authority dated Sep. 7, 2022 in PCT International Patent Application No. PCT/US2022/32208.

*Primary Examiner* — Eric S Ruppert
(74) *Attorney, Agent, or Firm* — Snell & Wilmer L.L.P.

(57) ABSTRACT

A heat exchanger may comprise a primary fluid path comprising an outer shell enclosing a primary cavity through which a primary fluid may flow; and a secondary fluid path coupled to the primary fluid path comprising a secondary fluid supply conduit, a secondary fluid exit conduit, and a first heat transfer element coupled fluidly between the secondary fluid supply conduit and the secondary fluid exit conduit, wherein the secondary fluid path is configured such that a secondary fluid may flow through the secondary fluid supply conduit, the first heat transfer element, and the secondary fluid exit conduit, which are in fluid communication with one another. The first heat transfer element, and additional heat transfer elements, may be disposed in the primary cavity such that the primary fluid contacts a secondary outer shell of the first heat transfer element.

10 Claims, 6 Drawing Sheets

(56) References Cited

U.S. PATENT DOCUMENTS

| | | | | |
|---|---|---|---|---|
| 2,590,436 | A * | 3/1952 | Luten, Jr. ..... | C01C 1/0482<br>208/146 |
| 5,061,177 | A | 10/1991 | Knipiler et al. | |
| 2020/0318861 | A1 | 10/2020 | Kikuchi et al. | |
| 2022/0128244 | A1 | 4/2022 | Drechsel et al. | |

* cited by examiner

METHODS AND SYSTEMS FOR A HEAT EXCHANGER

CROSS-REFERENCE TO RELATED APPLICATIONS

This application is a nonprovisional of, and claims priority to and the benefit of, U.S. Provisional Patent Application No. 63/197,237, filed Jun. 4, 2021 and entitled "METHODS AND SYSTEMS FOR A HEAT EXCHANGER," which is hereby incorporated by reference herein.

FIELD

The present disclosure relates generally to the transfer of thermal energy through a heat exchanger.

BACKGROUND

There are many applications in which the transfer of thermal energy between two fluids (e.g., liquids and/or gases) would be desirable. For example, the cooling or heating of a certain fluid flow through a machine may cause more efficient or better operation of the machine. A heat exchanger may facilitate the desired exchange of thermal energy between fluids (e.g., a shell and tube heat exchanger or a plate and frame heat exchanger). The structure and design of the heat exchanger may affect the performance of the heat exchanger and the efficacy and efficiency of the transfer of thermal energy between fluids.

SUMMARY

In various embodiments, a heat exchanger may comprise a primary fluid path comprising an outer shell enclosing a primary cavity through which a primary fluid may flow; and a secondary fluid path coupled to the primary fluid path comprising a secondary fluid supply conduit, a secondary fluid exit conduit, and a first heat transfer element coupled fluidly between the secondary fluid supply conduit and the secondary fluid exit conduit, wherein the secondary fluid path is configured such that a secondary fluid may flow through the secondary fluid supply conduit, the first heat transfer element, and the secondary fluid exit conduit, which are in fluid communication with one another. The first heat transfer element may be disposed in the primary cavity such that the primary fluid contacts a secondary outer shell of the first heat transfer element.

The heat exchanger may be configured to allow calculation of a first heat exchange amount resulting from the primary fluid contacting the secondary outer shell of the first heat transfer element. A heat exchanger may comprise heat transfer elements, in addition to the first heat transfer element, coupled fluidly between the secondary fluid supply conduit and the secondary fluid exit conduit and disposed in the primary cavity. The additional heat transfer elements may be in series with each other and the first heat transfer element. Heat exchange amounts resulting from the primary fluid contacting the secondary outer shells of the additional heat transfer elements may be calculated. Therefore, the number of heat transfer elements with which the primary fluid may contact to achieve a certain amount of thermal energy transfer, or a certain primary fluid final temperature, may be determined and implemented (e.g., by adding or removing heat transfer elements, or causing the primary fluid to avoid contact with heat transfer elements in excess of the necessary number of heat transfer elements).

In various embodiments, heat exchange amounts achieved by the additional heat transfer elements may be adjusted by adjusting the flow rate of the secondary fluid into and through each of the heat transfer elements. A flow regulator may be coupled to the respective heat transfer element at a heat transfer element inlet, which may be adjusted to adjust the secondary fluid flow rate in and through the respective heat transfer element.

In various embodiments, a method may comprise fluidly coupling a first heat transfer element between a secondary fluid supply conduit and a secondary fluid exit conduit of a secondary fluid path of a heat exchanger, wherein the secondary fluid path comprises the secondary fluid supply conduit, the secondary fluid exit conduit, and the first heat transfer element, wherein the secondary fluid supply conduit, the secondary fluid exit conduit, and the first heat transfer element are in fluid communication with one another, such that the secondary fluid path is configured to allow a secondary fluid to flow therethrough; coupling the secondary fluid path to a primary fluid path, wherein the primary fluid path comprises a primary outer shell enclosing a primary cavity through which a primary fluid can flow, wherein the first heat transfer element is disposed in the primary cavity such that the primary fluid contacts the first heat transfer element; determining an initial temperature for the primary fluid, wherein the initial temperature is the temperature of the primary fluid before contacting the first heat transfer element; determining a desired output temperature for the primary fluid, wherein the desired output temperature is the temperature at which the primary fluid exits the primary fluid path; calculating a first heat exchange amount resulting from the primary fluid contacting the first heat transfer element; determining an additional number of heat transfer elements needed to contact the primary fluid to achieve the desired output temperature; coupling the additional number of heat transfer elements between the secondary fluid supply conduit and the secondary fluid exit conduit such that the secondary fluid path comprises the additional number of heat transfer elements; and/or disposing the additional number of heat transfer elements in the primary cavity. In various embodiments, the first heat transfer element and the additional heat transfer elements are in series in the primary cavity. In various embodiments, at least a portion of the primary fluid path is linear. In various embodiments, at least one of the secondary fluid supply conduit and the secondary fluid exit conduit is external to the primary cavity. In various embodiments, at least one of the secondary fluid supply conduit and the secondary fluid exit conduit is internal to the primary cavity.

In various embodiments, the method may further comprise flowing the primary fluid through the primary fluid path; and flowing the secondary fluid through the secondary fluid path. In various embodiments, the method may further comprise adjusting a first heat transfer element flow rate, which is a secondary fluid flow rate through the first heat transfer element; and calculating a first adjusted heat exchange amount resulting from the primary fluid contacting the first heat transfer element resulting from the adjustment of the secondary fluid flow rate. In various embodiments, the method may further comprise adjusting a second heat transfer element flow rate, which is a secondary fluid flow rate through a second heat transfer element of the additional heat transfer elements, in response to the adjusting the first heat transfer element flow rate and the calculating a first adjusted heat exchange amount.

In various embodiments, a method may comprise flowing a primary fluid through a primary fluid path of a heat exchanger in a first direction, wherein heat exchanger further comprises a secondary fluid path comprising a secondary fluid supply conduit, a secondary fluid exit conduit, and a plurality of heat transfer elements, wherein each heat transfer element of the plurality of heat transfer elements is fluidly coupled between the secondary fluid supply conduit and the secondary fluid exit conduit such that a secondary fluid flows into the heat exchanger through the secondary fluid supply conduit, through a respective heat transfer element of the plurality of heat transfer elements, and exits the respective heat transfer element through the secondary fluid exit conduit; calculating a heat exchange amount between the primary fluid and the secondary fluid caused by each of the plurality of heat transfer elements; determining an appropriate number of heat transfer elements of the plurality of heat transfer elements to achieve a desired thermal energy transfer amount between the primary fluid and the secondary fluid; and/or flowing the secondary fluid through the secondary fluid path, including the appropriate number of heat transfer elements, of the heat exchanger in a second direction. In various embodiments, the first direction and the second direction may be the same or different.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1:
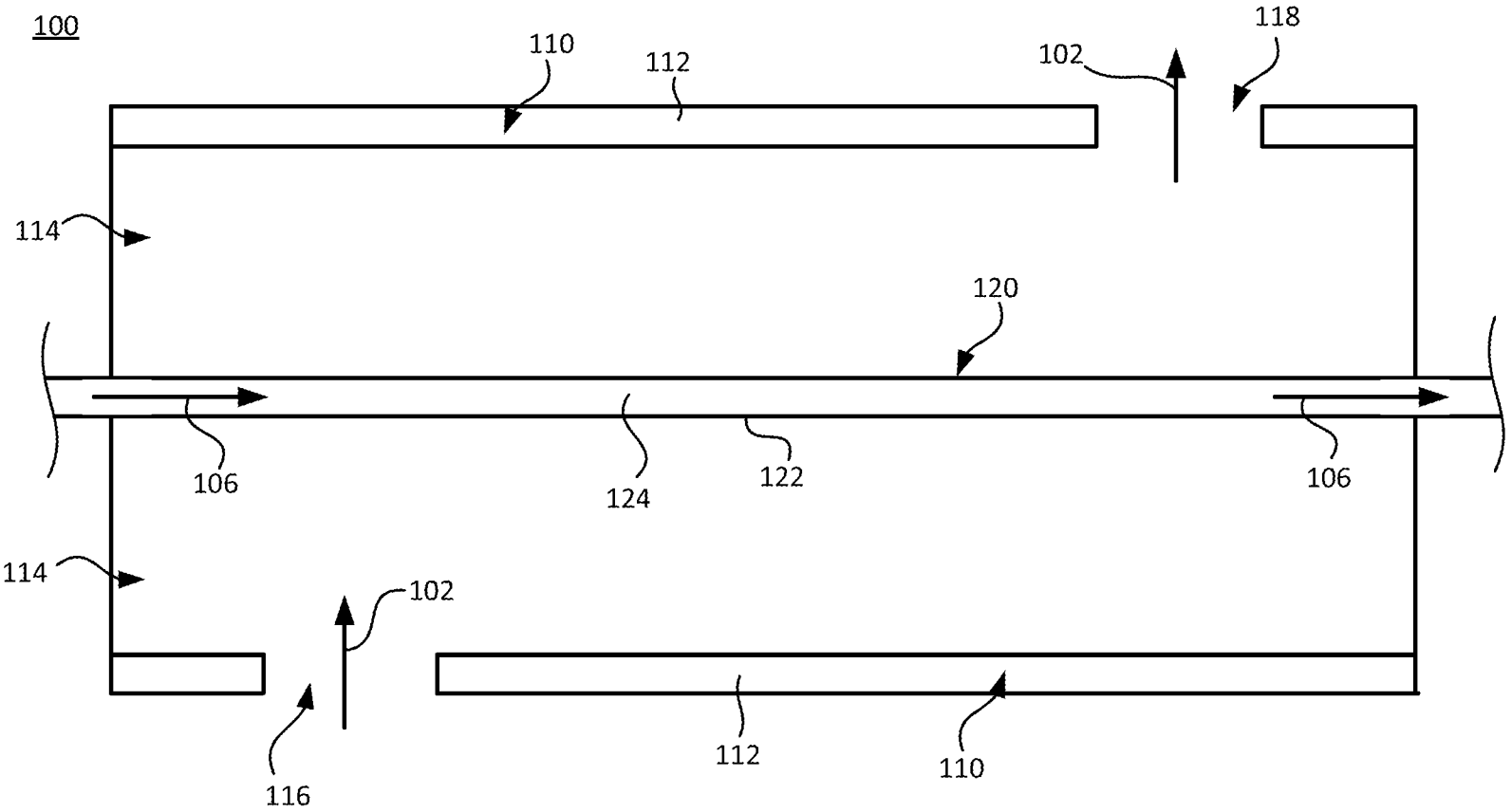
FIG. 1 illustrates a cross-sectional view of a shell and tube heat exchanger, in accordance with various embodiments.

Heat exchangers may comprise various designs (e.g., shell and tube or plate and frame) and/or various structures. For example, FIG. 1 illustrates a cross-sectional view of an exemplary shell and tube heat exchanger 100. Heat exchanger 100 may comprise a primary fluid conduit 110 comprising a primary outer shell 112 enclosing a primary cavity 114, through which a primary fluid (e.g., a liquid and/or gas) may flow. For example, primary fluid conduit 110 may serve as a primary fluid path for a primary fluid. Primary fluid conduit 110 may comprise an primary conduit inlet 116, through which primary fluid 102 enters primary outer shell 112 and primary cavity 114, and a primary conduit outlet 118, through which primary fluid 102 exits primary outer shell 112 and primary cavity 114.

Heat exchanger 100 may further comprise a secondary fluid conduit 120 comprising a secondary outer shell 122 enclosing a secondary cavity 124, through which a secondary fluid 106 (e.g., a liquid and/or gas) may flow. At least a portion of secondary fluid conduit 120 may be disposed within primary cavity 114, such that secondary outer shell 122 comes in contact with primary fluid 102. As used herein, "secondary outer shell" will refer to the contact area of the primary and secondary fluids in a heat exchanger, or the surface region of the secondary fluid conduit or the secondary fluid path separating the primary and secondary fluids in a heat exchanger. In various embodiments, secondary fluid conduit 120 is disposed within primary cavity 114 such that primary fluid 102 surrounds secondary fluid conduit 120. Primary cavity 114 and secondary cavity 124 may be fluidly separate such that primary fluid 102 and secondary fluid 106 may not mix or come in physical contact with one another.

Realizing that terminology in the heat exchanger technological arena may vary depending on the orientation of one fluid flow relative to another, or the type of process (e.g., heating or condensing), as used herein, parts of a heat exchanger with the designation "primary" are the fluid conduit (and associated components) and fluid which at least partially encapsulate or surround the other fluid conduit. The "primary" fluid may be the fluid upon which heat transfer is desired (i.e., the fluid that is desired to reach a certain temperature, phase, or the like). Accordingly, as used herein, parts of a heat exchanger with the designation "secondary" are the fluid conduit (and associated components) and fluid which is at least partially encapsulated or surrounded by the other fluid conduit (i.e., the primary fluid conduit). The "secondary" fluid may be fluid which transfers heat to or from the primary fluid to achieve the desired result. However, the components and their functions described herein (or the terminology used to refer to the components and their functions) may be reversed or changed without going outside the scope of this disclosure. For example, primary and secondary fluid conduits may be in contact and/or thermal communication with one another in any suitable manner, including not being disposed with one encapsulated in the other.

Secondary outer shell 122 may be in thermal communication with primary fluid 102 and/or secondary fluid 106.

Accordingly, thermal energy may be transferred between primary fluid 102 and secondary fluid 106 through secondary outer shell 122. Depending on the objective, primary fluid 102 may be cooled or heated by secondary fluid 106, or vice versa. For example, if the objective is to heat primary fluid 102 (or cool secondary fluid 106), primary fluid 102 may enter primary cavity 114 through primary conduit inlet 116 having a temperature lower than when primary fluid 102 exits primary cavity 114 through primary conduit outlet 118. Likewise, secondary fluid 106 may enter secondary cavity 124 (or the portion of secondary fluid conduit 120 disposed within primary cavity 114) having a temperature higher than when secondary fluid 106 exits secondary cavity 124 (or the portion of secondary fluid conduit 120 disposed within primary cavity 114). In this example, primary fluid 102 absorbs thermal energy from secondary fluid 106 while primary fluid 102 and secondary fluid 106 are present within heat exchanger 100. Conversely, for example, if the objective is to cool primary fluid 102 (or heat secondary fluid 106), primary fluid 102 may enter primary cavity 114 through primary conduit inlet 116 having a temperature higher than when primary fluid 102 exits primary cavity 114 through primary conduit outlet 118. Likewise, secondary fluid 106 may enter secondary cavity 124 (or the portion of secondary fluid conduit 120 disposed within primary cavity 114) having a temperature lower than when secondary fluid 106 exits secondary cavity 124 (or the portion of secondary fluid conduit 120 disposed within primary cavity 114). In this example, primary fluid 102 transfers thermal energy to secondary fluid 106, which secondary fluid 106 absorbs, while primary fluid 102 and secondary fluid 106 are present within heat exchanger 100.

The flow directions of primary fluid 102 and secondary fluid 106 may be parallel (i.e., flowing in the same, or same general, direction), opposite (i.e., flowing in opposite, or generally opposite, directions), or any other directions which may optimize, or accomplish a desired, thermal energy transfer between primary fluid 102 and secondary fluid 106. Additionally, primary cavity 114 (or the fluid path of primary fluid 102) and/or secondary cavity 124 (or the fluid path of secondary fluid 106) may comprise any shape or arrangement such as a zigzag, u-shape, spiral, or the like to accomplish the desired thermal energy transfer between primary fluid 102 and secondary fluid 106. A heat exchanger design may comprise, in various embodiments, multiple passages where the secondary fluid conduit is exposed to the primary fluid in the primary fluid conduit one, two, or more times in an effort to efficiently transfer thermal energy between fluids.

Traditional structures or designs of heat exchangers, such as heat exchanger 100 in FIG. 1, may cause flow patterns and streamlines of the fluids that may not be conducive to an ideal or desired thermal energy transfer between fluids. For example, the design of a heat exchanger may not allow precise calculation and prediction of the amount of heat transfer between a primary and secondary fluid, therefore precluding the precision in fluid temperatures which may be desired or required for a certain industrial application.

With reference to FIG. 2, at least a portion of a heat exchanger 200 comprising heat transfer elements 250 within a fluid path is depicted, in accordance with various embodiments. Heat exchanger 200 may comprise a primary fluid conduit 210 comprising a primary outer shell 212 enclosing a primary cavity 214, through which a primary fluid 202 (e.g., a liquid and/or gas) may flow. For example, primary fluid conduit 210 may serve as a primary fluid path for primary fluid 202. Primary fluid conduit 210 may comprise an primary conduit inlet, through which primary fluid 202 enters primary outer shell 212 and primary cavity 214, and a primary conduit outlet, through which primary fluid 202 exits primary outer shell 212 and primary cavity 214. The primary fluid path and/or primary cavity 214 may be any suitable shape or arrangement such as a zigzag, u-shape, spiral, or the like. In various embodiments, at least a portion of the primary fluid path and/or primary cavity 214 may be linear.

In various embodiments, primary outer shell 212 may comprise an opening in which a hatch 216 may be disposed. Hatch 216 may be disposed in the opening to seal and/or separate (i.e., fluidly isolate) primary cavity 214 from the surrounding environment external to primary outer shell 212 and/or primary cavity 214 such that primary fluid 202 may not exit primary cavity 214 through the opening. In various embodiments, hatch 216 may be removed and/or rotated (e.g., about hinges coupled to primary outer shell 212 and hatch 216) such that the opening in primary outer shell 212 causes primary cavity 214 to be in fluid communication with the surrounding environment external to primary outer shell 212 and/or primary cavity 214. The opening in primary outer shell 212 may allow access to primary cavity 214 and components disposed therein (e.g., heat transfer elements 250, secondary fluid exit conduit 225, and/or the like).

Heat exchanger 200 may further comprise a secondary fluid path comprising a secondary fluid supply conduit 221, a secondary fluid exit conduit 225, and at least one heat transfer element 250. An outer wall may enclose a secondary cavity throughout the secondary fluid path such that secondary fluid supply conduit 221, secondary fluid exit conduit 225, and heat transfer element(s) 250 may be in fluid communication with one another. Thus, a secondary fluid 206 may flow through secondary fluid supply conduit 221, secondary fluid exit conduit 225, and heat transfer element(s) 250.

In various embodiments, secondary fluid supply conduit 221 may be a pathway through which secondary fluid 206 travels to reach heat transfer element(s) 250. Secondary fluid supply conduit 221 may be disposed such that secondary fluid supply conduit 221 does not contact primary fluid 202. Therefore, secondary fluid supply conduit 221 may be disposed in heat exchanger 200 external to primary cavity 214 and/or primary fluid conduit 210. The flow of secondary fluid 206 within secondary fluid supply conduit 221 may be parallel to the flow of primary fluid 202 (i.e., primary fluid 202 and secondary fluid 206 flow in the same direction) or counter to the flow of primary fluid 202 (i.e., primary fluid 202 and secondary fluid 206 flow in opposite or otherwise different directions).

Each heat transfer element 250 may comprise a heat transfer element inlet 253 fluidly coupling secondary fluid supply conduit 221 to the respective heat transfer element 250. At least one heat transfer element inlet 253 provides a path for secondary fluid 206 to flow from secondary fluid supply conduit 221 to the respective heat transfer element 250. In various embodiments, a flow regulator 255 may be coupled to at least one heat element inlet 253. Flow regulator 255 may be a valve or other similar device capable of increasing or decreasing the flow of secondary fluid 206 through heat transfer element inlet 253 and into and through the respective heat transfer element 250. Flow regulator 255 may be electronically, mechanically, and/or manually operated to regulate flow of secondary fluid 206. In various embodiments, a temperature change device 257 (e.g., a thermocouple, heater, cooler, and/or the like) may be coupled to at least one heat element inlet 253 and/or on any other suitable portion of a heat transfer element 250 or the secondary fluid path. Temperature change device 257 may be configured to facilitate a change in temperature of secondary fluid 206 flowing through the respective heat transfer element 250 (or any other part of the secondary fluid path to which the temperature change device affects), such that the heat exchange amount for the respective heat transfer element may be changed based on a desired thermal energy transfer amount. Temperature change device 257 may increase or decrease in temperature, causing a temperature change of the coupled portion of heat transfer element 250, or the respective portion of the secondary fluid path, and secondary fluid 206 within. In various embodiments, temperature change device 257 may gradually change temperature of the relevant portion of the secondary fluid path. In various embodiments, each temperature change device 257 may sequentially change the temperature of secondary fluid 206, and therefore, sequentially change the heat exchange amount between heat transfer elements 250.

In various embodiments, heat transfer element(s) 250 may be coupled (fluidly and/or physically) between secondary fluid supply conduit 221 and secondary fluid exit conduit 225 such that secondary fluid 206 flows through secondary fluid supply conduit 221, enters and flows through heat transfer element(s) 250, and exits heat transfer element(s) 250 and flows through secondary fluid exit conduit 225. Heat transfer elements 250 may be fluidly coupled in parallel between secondary fluid supply conduit 221 and secondary fluid exit conduit 225. At least a portion of heat transfer element(s) 250 may be disposed within primary cavity 214, such that the secondary outer shell of heat transfer element(s) 250 comes in contact with primary fluid 202.

In various embodiments, heat transfer element(s) 250 may have a cross-sectional shape that is complementary to a cross-sectional shape of primary cavity 214 (the cross sections being taken perpendicular to the axis of flow of primary fluid 202, as depicted in FIG. 2), such that the cross-sectional shape of heat transfer element(s) 250 occupies at least a portion of the cross-sectional area of primary cavity 214. That way, at least a portion of (or a majority or all of) primary fluid 202 may contact a secondary outer shell 252 of a heat transfer element 250 no matter where the primary fluid 202 is disposed in and/or flowing through primary cavity 214. For example, the cross section of primary cavity 214 may be circular, and the cross section of heat transfer element(s) 250 may be circular, with an outer diameter that is complementary to the cross-sectional dimensions of the circular primary cavity 214. Secondary outer shell 252 may comprise any suitable material that allows thermal energy exchange between primary fluid 202 and secondary fluid 206 contacting secondary outer shell 252.

Figure 3:
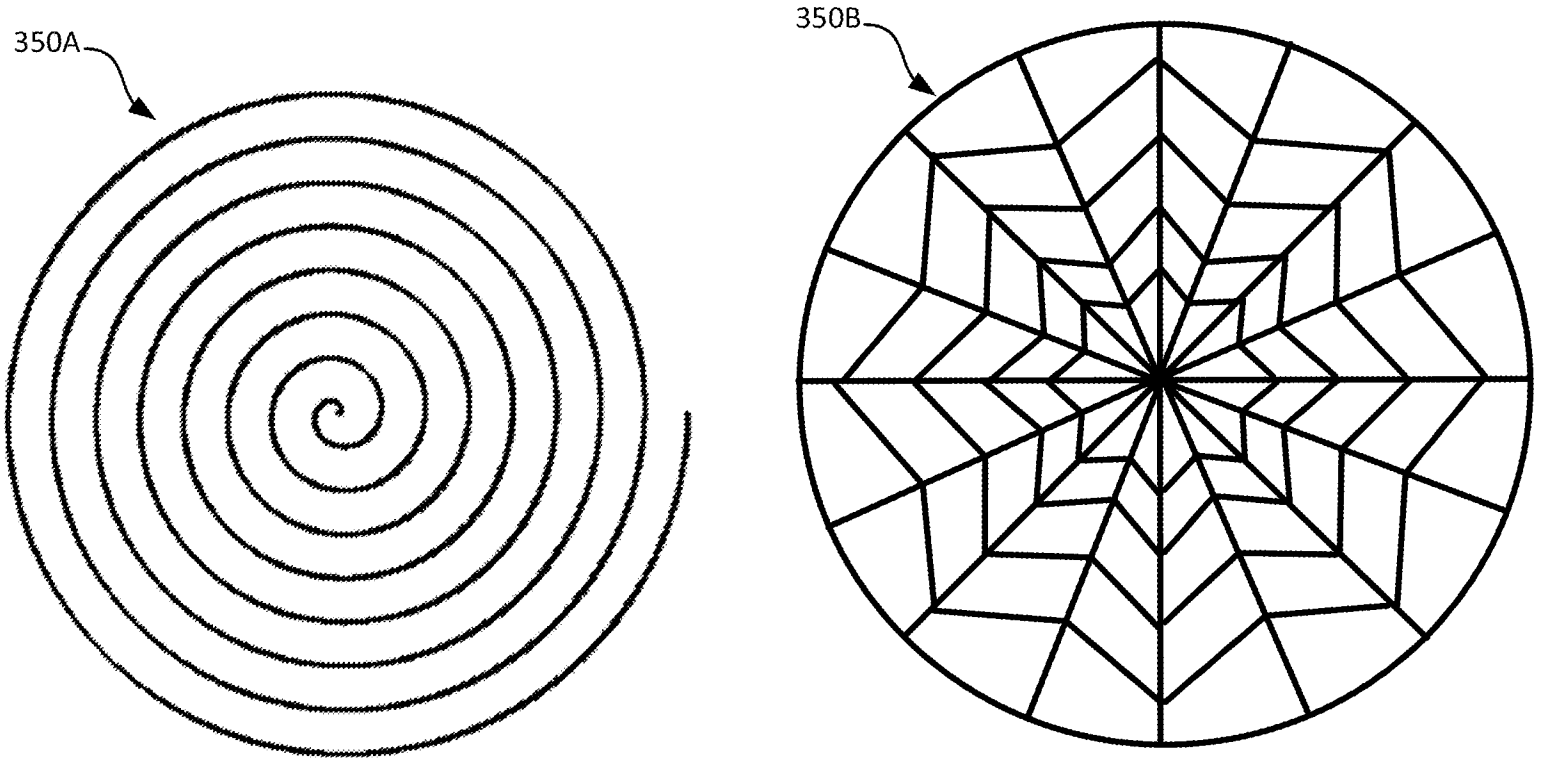
FIG. 3 illustrates exemplary cross-sectional shapes of heat transfer elements for inclusion in a heat exchanger, in accordance with various embodiments.

Heat transfer element(s) 250 within heat exchanger 200 may comprise any suitable shape or design (e.g., having a circular cross-sectional shape, a teardrop shape, a conical or frusto-conical shape, a spiral shape, a helical shape, and/or the like). The design of heat transfer elements 250 may be configured to contact primary fluid 202, while allowing the flow of primary fluid 202 through primary cavity 214 to continue. As discussed above, the cross-sectional shape (i.e., the shape of the outermost perimeter of heat transfer element(s) 250) may be any suitable shape, such as complementary to the cross-sectional shape of primary cavity 214. In various embodiments, heat transfer element(s) 250 may comprise a design comprising filaments. With further reference to FIG. 3, for example, a heat transfer element (e.g., heat transfer element 250) may comprise a spiral design, such as heat transfer element 350A. A spiral design may comprise a single filament disposed in a spiral design, such that secondary fluid 206 may enter the spiral design on one filament end of heat transfer element 305A, and exit the spiral design on another filament end (e.g., the only other end) of heat transfer element 305A. As another example, a heat transfer element (e.g., heat transfer element 250) may comprise a web design, such as heat transfer element 350B. A web design may comprise a filament network such that secondary fluid 206 may flow systematically through heat transfer element 350B. During heat exchanger operation comprising heat transfer elements (e.g., heat transfer elements 350A and/or 350B), primary fluid 202 may flow between the filaments to continue flowing through primary cavity 214.

In various embodiments, heat transfer elements 250 may comprise a two-dimensional shape. In other words, heat transfer elements 250 may span and take up space only in a direction substantially perpendicular to the flow of primary fluid 202 through primary cavity 214 (i.e., within at least a portion of the cross-sectional area of primary cavity 214, as discussed above), other than the width of the secondary cavity through which secondary fluid 206 may flow. In various embodiments, heat transfer elements 250 may comprise a three-dimensional shape. In other words, heat transfer elements 250 may span in a direction substantially perpendicular to the flow of primary fluid 202 through primary cavity 214, as discussed above, as well spanning along primary cavity 214 (i.e., axially and/or substantially in the direction of the flow of primary fluid 202). For example, the spiral design of heat transfer element 350A, or the web design of heat transfer element 350B, may take the three-dimensional shape of a cone, such as heat transfer elements 450, depicted in FIG. 4, having a spiral conical shape. In various embodiments, heat transfer elements 250 may comprise different shapes or designs within a heat exchanger.

Primary cavity 214 and the secondary cavity enclosed within secondary outer shell 252 may be fluidly separate such that primary fluid 202 and secondary fluid 206 may not mix or come in physical contact with one another.

In various embodiments, heat exchanger 200 may comprise two or more heat transfer elements 250, such as heat transfer elements 250A and 250B, as depicted in FIG. 2. Heat transfer elements 250 may be disposed within primary cavity 214 in series such that primary fluid 202 contacts heat transfer elements 250A and 250B sequentially while flowing through and within primary cavity 214. A heat exchanger (e.g., heat exchanger 200) may comprise any suitable or desired number of heat transfer elements 250.

In various embodiments, secondary fluid exit conduit 225 may be a pathway through which secondary fluid 206 travels in response to exiting a heat transfer element(s) 250. Secondary fluid 206 flowing in each of multiple heat transfer elements 250 may flow into secondary fluid exit conduit 225 in response to exiting the respective heat transfer element 250. Secondary fluid exit conduit 225 may be disposed in heat exchanger 200 internal or external to primary cavity 214 and/or primary fluid conduit 210. In various embodiments, secondary fluid exit conduit 225 may comprise any suitable material. For example, secondary fluid exit conduit 225 may comprise insulation material to reduce or prevent thermal energy transfer between secondary fluid 206 within secondary fluid exit conduit 225 and adjacent primary fluid 202 flowing through primary cavity 214. The flow of secondary fluid 206 within secondary fluid exit conduit 225 may be parallel to the flow of primary fluid 202 (i.e., primary fluid 202 and secondary fluid 206 flow in the same direction)

or counter to the flow of primary fluid 202 (i.e., primary fluid 202 and secondary fluid 206 flow in opposite or otherwise different directions).

The secondary fluid path may comprise heat element outlets 254 fluidly coupling secondary fluid exit conduit 225 to respective heat transfer elements 250. That is, each heat transfer element 250 may comprise at least one heat element outlet 254 fluidly coupled to the respective heat transfer element 250 and secondary fluid exit conduit 225, such that the at least one heat element outlet 254 provides a path for secondary fluid 206 to flow from a respective heat transfer element 250 to secondary fluid exit conduit 225.

Figure 2A:
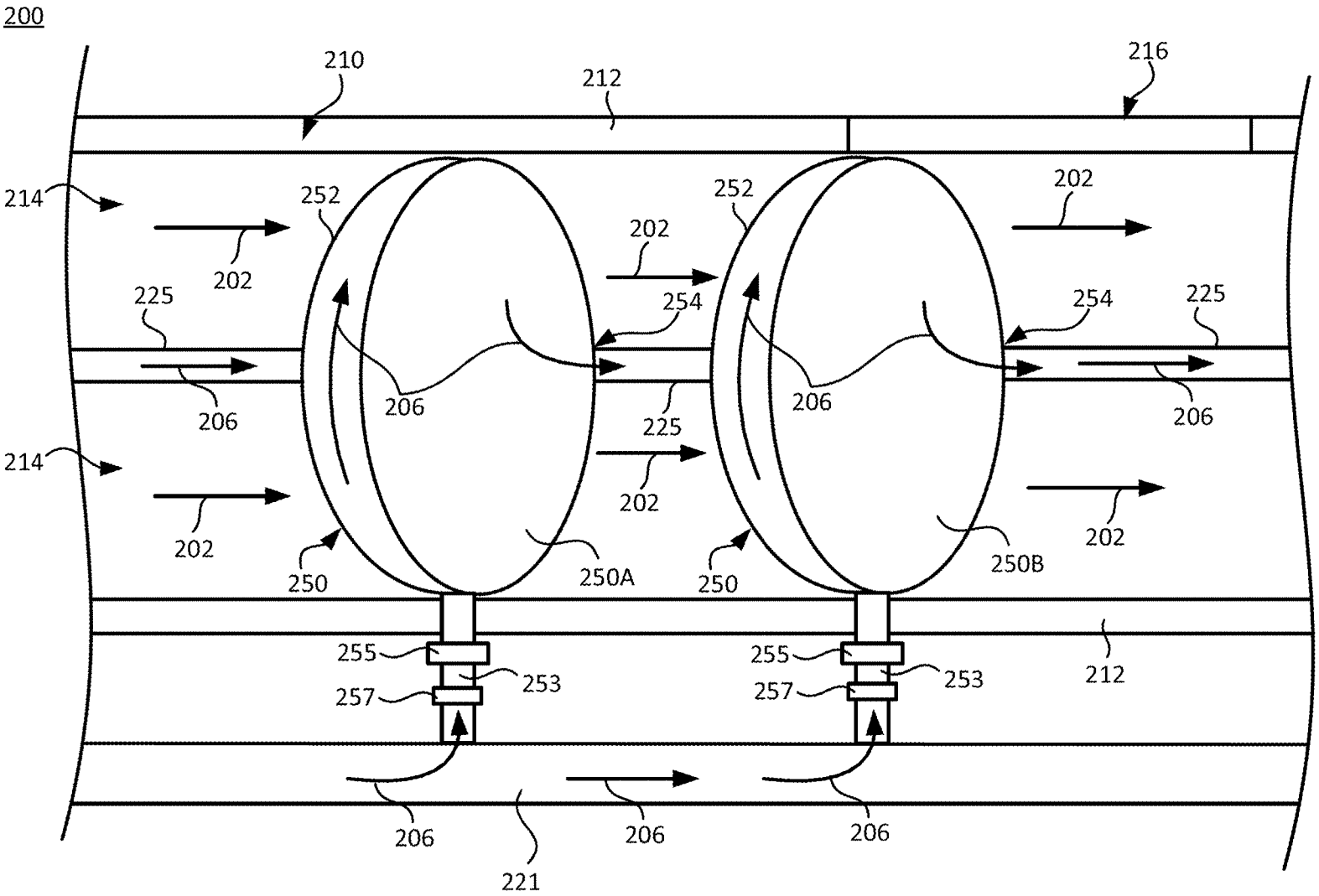
FIG. 2A illustrates an exemplary heat exchanger having heat transfer elements within a fluid path, in accordance with various embodiments.

Secondary fluid exit conduit 225 may transport secondary fluid 206 out of heat exchanger 200, and/or away from contact with primary fluid 202. The secondary fluid 206 in secondary fluid exit conduit 225 may have already participated in the thermal energy transfer between primary fluid 202 and secondary fluid 206 while secondary fluid 206 was flowing through a heat transfer element(s) 250. To summarize the flow path of secondary fluid 206, secondary fluid 206 may begin by flowing in secondary fluid supply conduit 221, and different portions of secondary fluid 206 may flow into and through different heat transfer elements 250. That is, the same portion of secondary fluid 206 may not flow through multiple heat transfer elements 250. The portions of secondary fluid 206 exit their respective heat transfer elements 250, and flow into secondary fluid exit conduit 225. Secondary fluid exit conduit 225 may be within primary cavity 214 (e.g., as depicted in FIG. 2A), or, in various embodiments, the secondary fluid exit conduit may be disposed outside primary cavity 214, such that the secondary fluid exit conduit is not in contact with the primary fluid.

Figure 4:
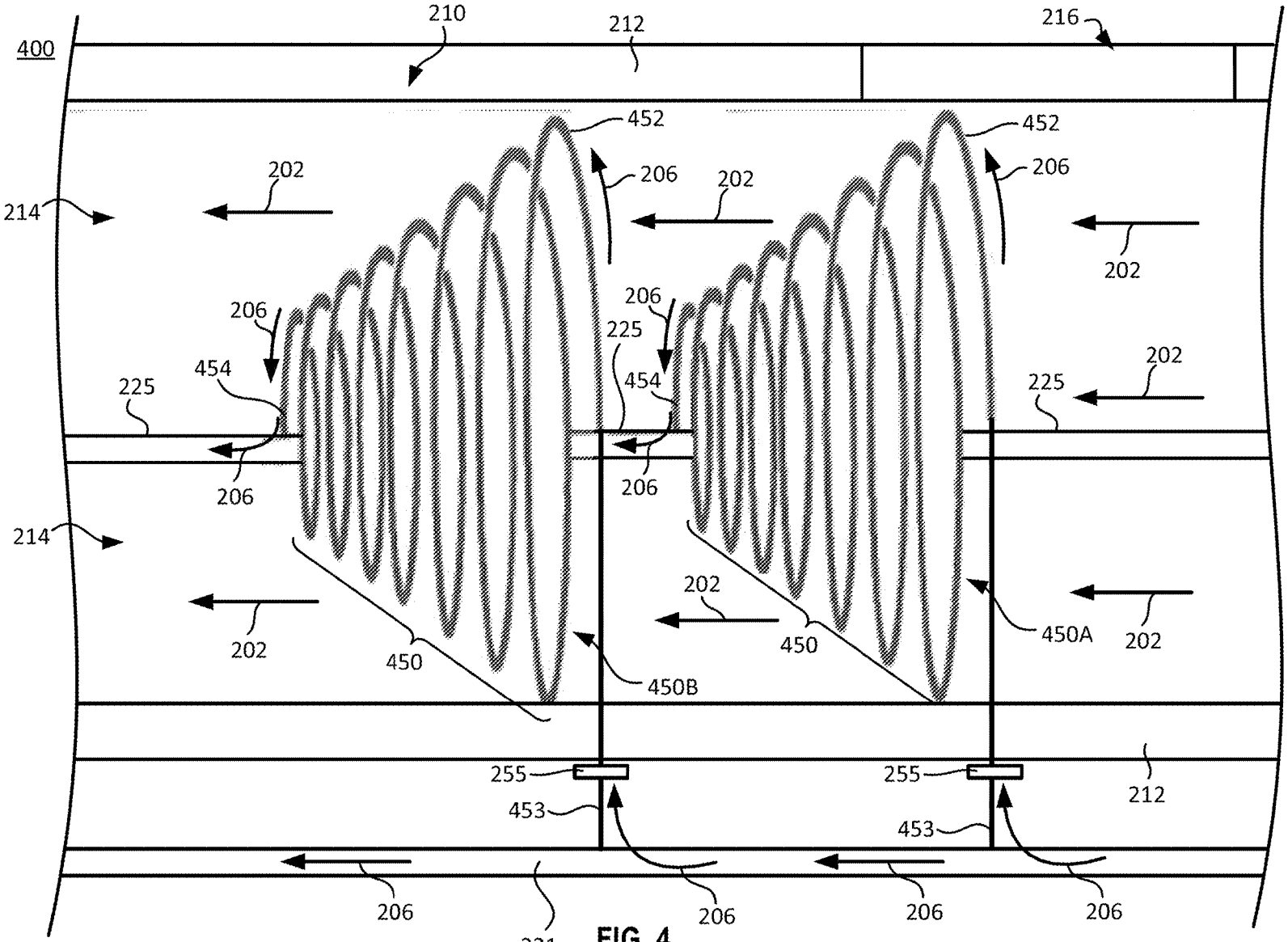
FIG. 4 illustrates an exemplary heat exchanger having heat transfer elements with a spiral conical shape within a fluid path, in accordance with various embodiments.

With reference to FIG. 4, a heat exchanger 400 having heat transfer elements 450 comprising a spiral conical shape comprised in a secondary fluid path is depicted, in accordance with various embodiments. Elements with the like element numbering throughout the figures are intended to be the same. In accordance with various embodiments, heat exchanger 400 may comprise heat transfer elements 450 comprising a spiral conical shape. Heat transfer elements 450A and 450B may be comprised of a filament disposed in a spiral conical shape within primary cavity 214. Heat transfer elements 450A and 450B may comprise a secondary outer shell 452 enclosing a secondary cavity in heat transfer elements 450A and 450B through which secondary fluid 206 may flow.

During operation, primary fluid 202 may flow through primary cavity 214, and secondary fluid 206 may flow through secondary fluid supply conduit 221. A first portion of secondary fluid 206 may flow through the heat transfer element inlet 453 for heat transfer element 450A, which is fluidly coupled to, or a part of, heat transfer element 450A. The heat transfer element inlet 453 for heat transfer element 450A may be disposed between secondary fluid supply conduit 221 and heat transfer element 450A (i.e., downstream of secondary fluid supply conduit 221 and upstream of heat transfer element 450A) such that secondary fluid may flow from secondary fluid supply conduit 221, and into and through the heat transfer element inlet 453 for heat transfer element 450A to reach heat transfer element 450A. In response, the first portion of secondary fluid 206 may enter heat transfer element 450A, and flow therethrough. Secondary outer shell 452 may be in thermal communication with primary fluid 202 and/or secondary fluid 206. While the first portion of secondary fluid 206 is in heat transfer element 450A and flowing therethrough, thermal energy may be transferred between the first portion of secondary fluid 206 and primary fluid 202 in contact and/or proximate to secondary outer shell 452 of heat transfer element 450A.

Depending on the objective, primary fluid 202 may be cooled or heated by secondary fluid 206, or vice versa. For example, if the objective is to heat primary fluid 202 (or cool secondary fluid 206), primary fluid 202 may enter primary cavity 214 having a temperature lower than after primary fluid 202 contacts one or more heat transfer elements 450 and/or when primary fluid 202 exits primary cavity 214. Likewise, the first portion of secondary fluid 206, discussed above, may enter heat transfer element 450A through the respective heat transfer element inlet 453 having a temperature higher than when the first portion of secondary fluid 206 exits heat transfer element 450A through the respective heat transfer element outlet 454. In this example, the primary fluid 202 contacting heat transfer element 450A absorbs thermal energy from the first portion of secondary fluid 206 present in heat transfer element 450A. Conversely, for example, if the objective is to cool primary fluid 202 (or heat secondary fluid 206), primary fluid 202 may enter primary cavity 214 having a temperature higher than after primary fluid 202 contacts one or more heat transfer elements 450 and/or when primary fluid 202 exits primary cavity 214. Likewise, the first portion of secondary fluid 206, discussed above, may enter heat transfer element 450A through the respective heat transfer element inlet 453 having a temperature lower than when the first portion of secondary fluid 206 exits heat transfer element 450A through the respective heat transfer element outlet 454. In this example, the primary fluid 202 contacting heat transfer element 450A transfers thermal energy to the first portion of secondary fluid 206 present in heat transfer element 450A.

Having multiple heat transfer elements 450 in series, as discussed above in relation to heat transfer elements 250 in FIG. 2, may allow calculated heat transfer events to take place involving primary fluid 202 while flowing through primary cavity 214. A heat transfer event may be the thermal energy transfer between primary fluid 202 contacting a heat transfer element 450 and the portion of secondary fluid 206 within the heat transfer element 450 during the heat transfer event.

In implementing calculated heat transfer events, during operation, secondary fluid 206 may flow through secondary fluid supply conduit 221. A first portion of secondary fluid 206 may flow into heat transfer element 450A (the first heat transfer element 450 in series), and a second portion of secondary fluid 206 may flow through heat transfer element 450B. The first and second portions of secondary fluid 206 may exit secondary fluid supply conduit 221 through the respective heat transfer element inlet 453 for each heat transfer element 450. In various embodiments, primary fluid 202 may flow through primary cavity 214 at the same time as portions of secondary fluid 206 are flowing through respective heat transfer elements 450. Primary fluid 202 may contact the secondary outer shell 452 of heat transfer element 450A while the first portion of secondary fluid 206 is within heat transfer element 450A. In response, a heat transfer event may occur wherein thermal energy is transferred between (i.e., to or from) primary fluid 202 and (i.e., from or to) the first portion of secondary fluid 206 through outer shell 452 of heat transfer element 450A. Therefore, a certain first amount of thermal energy may be transferred to or from the primary fluid 202. Subsequently, primary fluid 202 (which just participated in a heat transfer event with the first portion of secondary fluid 206 in heat transfer element 450A) may contact another heat transfer element 450 (e.g., heat transfer element 450B). In response, another heat transfer event may occur wherein thermal energy is transferred between (i.e., to or from) primary fluid 202 and (i.e., from or to) the second portion of secondary fluid 206 through outer shell 452 of heat transfer element 450B. Therefore, a certain second amount of thermal energy may be transferred to or from primary fluid 202. The first and second portions of secondary fluid 206 involved in the described heat transfer events may exit their respective heat transfer elements 450, and continue to flow through and/or out of heat exchanger 400 through secondary fluid exit conduit 225. Reference to the first and second portions of secondary fluid 206 flowing through respective heat transfer elements 450 is to illustrate that the same portion of secondary fluid 206 may not flow through multiple heat transfer elements 450. However, secondary fluid 206 from secondary fluid supply conduit 221 may continue to flow into and through heat transfer elements 450 to continue to transfer thermal energy with continued flow of primary fluid 202. In various embodiments, the secondary fluid may enter each heat transfer element (e.g., heat transfer elements 450A and 450B) having the same initial temperature (e.g., the temperature in secondary fluid supply conduit 221).

Primary fluid 202 may contact any number of desired heat transfer elements 450 to cause primary fluid 202 to achieve a desired level of thermal energy absorption or loss. As such, the temperature change to primary fluid 202 resulting from contact with each heat transfer element 450 may be calculated, for example, for a certain starting temperature, flow rate, etc. of primary fluid 202, and certain starting temperature(s) and flow rate(s) of secondary fluid 206 within each heat transfer element 450 (the temperature and/or flow rate of secondary fluid 206 may be adjusted for each heat transfer element 450). Accordingly, a heat exchanger (e.g., heat exchanger 400) may be designed with a number of heat transfer elements 450, each having a known (i.e., calculated) respective heat exchange amount (i.e., the amount of thermal energy transferred to or from primary fluid 202 contacting the respective heat transfer element 450 with secondary fluid 206 flowing therethrough), that would achieve a desired temperature change in primary fluid 202 resulting from contact with all of the heat transfer elements 450. Or, in various embodiments, primary fluid 202 may be directed to exit heat exchanger 400, or directed to avoid contact with further heat transfer elements 450, after a desired amount of heat transfer to or from primary fluid 202 has been achieved resulting from primary fluid 202 contacting the number of heat transfer elements 450 required to achieve the desired heat transfer. Additionally, the heat transfer achieved by each specific heat transfer element 450 may be calculated and/or adjusted by adjusting the secondary fluid 206 flow rate through a heat transfer element 450. In various embodiments, as discussed above, the flow rate of secondary fluid 206 through a heat transfer element 450 may be achieved by adjusting the flow regulator 255 coupled to the heat transfer element inlet 453 for the respective heat transfer element 450.

Figure 2B:
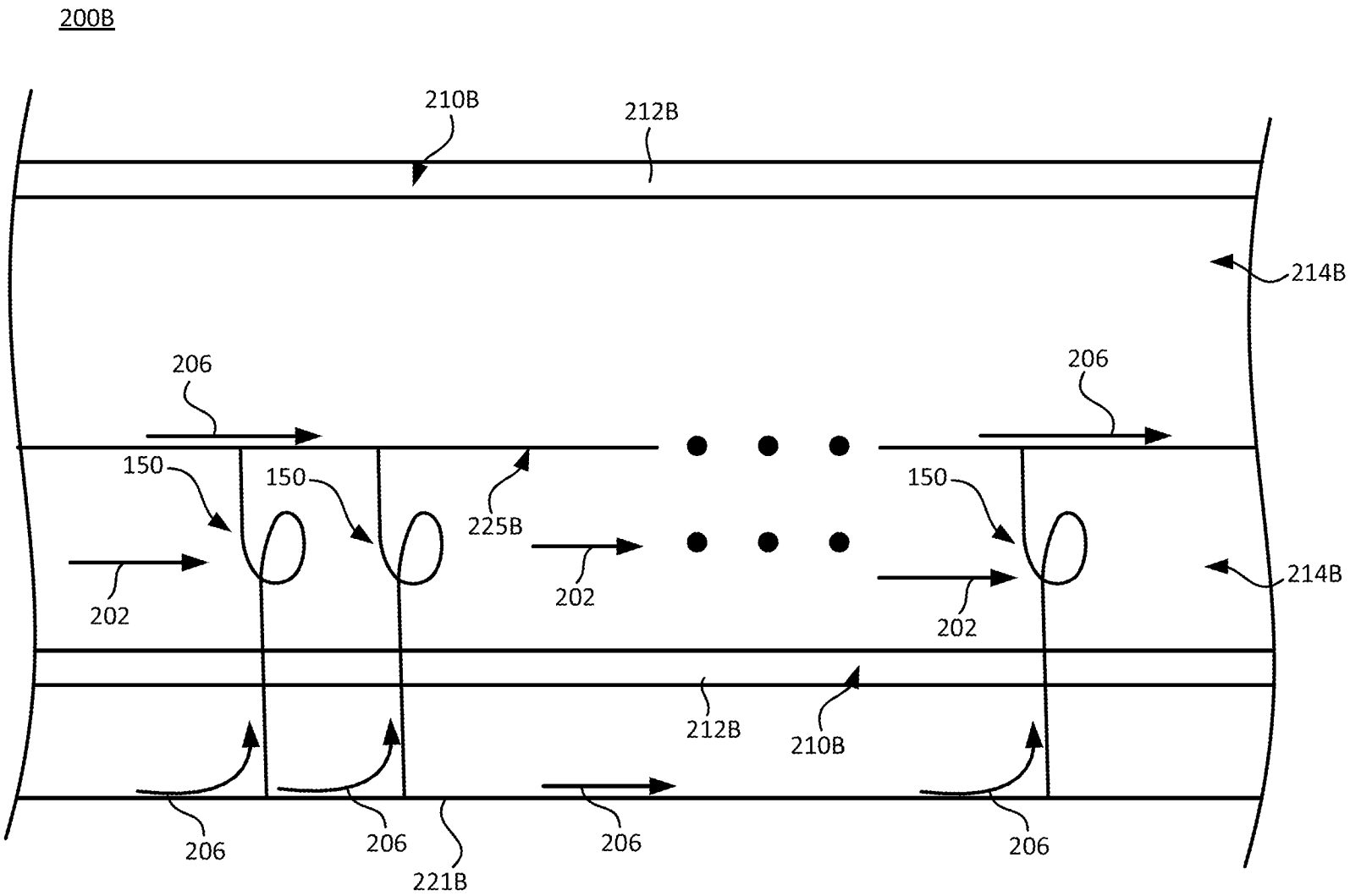
FIG. 2B illustrates a schematic diagram of an exemplary heat exchanger having heat transfer elements within a fluid path, in accordance with various embodiments.

Providing a schematic diagram of a heat exchanger having heat transfer elements, as discussed herein, FIG. 2B depicts heat exchanger 200B. Similar to heat exchanger 200 in FIG. 2A, heat exchanger 200B comprises a primary fluid conduit 210B enclosed by a primary outer shell 212B. Primary fluid 202 may flow through primary fluid path 210B. Heat exchanger 200B may further comprise a secondary fluid path comprising a secondary fluid supply conduit 221B, a secondary fluid exit conduit 225B, and a desired number heat transfer elements 150 (a schematic version of heat transfer elements 205 depicted in FIG. 2A). Heat transfer elements 150 may take any suitable shape or form, as discussed herein. Secondary fluid 206 may flow through the secondary fluid path.

As discussed herein, based on a desired thermal energy transfer amount between primary fluid 202 and secondary fluid 206, any desired number of heat transfer elements 150 may be comprised in the secondary fluid path and disposed within primary fluid path 210B and/or in contact with primary fluid path 214B (as indicated by the ellipsis in secondary fluid exit conduit 225B and the series of heat transfer elements 150). That is, with each heat transfer element 150 effecting a known (calculated) heat exchange amount between primary fluid 202 and secondary fluid 206, heat exchanger 200B may be provided with the appropriate number of heat transfer elements 150 to achieve the desired thermal energy transfer amount between primary fluid 202 and secondary fluid 206 (e.g., for primary fluid 202 and/or secondary fluid 206 to achieve a desired temperature).

In various embodiments, the original temperature of heat transfer elements before effecting thermal energy transfer with a primary fluid can be regulated by the temperature or flow rate of the secondary fluid, as discussed herein, or in any other suitable manner. For example, the secondary flow path may be configured to facilitate the flow of electricity. Electricity may be what causes the heat transfer elements to have a certain temperature to facilitate a certain level of thermal energy transfer with the primary fluid. Therefore, the electricity provided to each heat transfer element can be adjusted (e.g., by a regulator) to achieve a desired temperature of the respective heat transfer element and a desired level of thermal energy transfer with the primary fluid. In such embodiments, keeping with the terminology used herein, the secondary fluid may be electrical current flowing through the secondary flow path and/or heat transfer elements (rather than a liquid or gas).

In various embodiments, the primary fluid path and heat transfer elements disposed therein can be disposed in any suitable direction. For example, the heat transfer elements to be contacted by the primary fluid can be disposed horizontally relative to one another. As another example, the heat transfer elements to be contacted by the primary fluid can be disposed substantially vertically relative to one another (or at any suitable angle(s) between horizontal and vertical). With heat transfer elements in a substantially vertical arrangement, the heat exchanger may be configured to cause a phase change of the primary fluid. For example, the primary fluid can be a liquid that is heated causing a phase change to vapor, the vapor travels along (e.g., up) the primary fluid conduit and contacts the heat transfer elements. At a desired level in the primary fluid conduit or at a desired heat transfer element (facilitated by the selected temperatures of the respective heat transfer elements), the heat exchanger may be configured to condense the vapor primary fluid into a liquid (e.g., heat exchangers in accordance with various embodiments of this disclosure may be used as stills for distillation).

Figure 5:
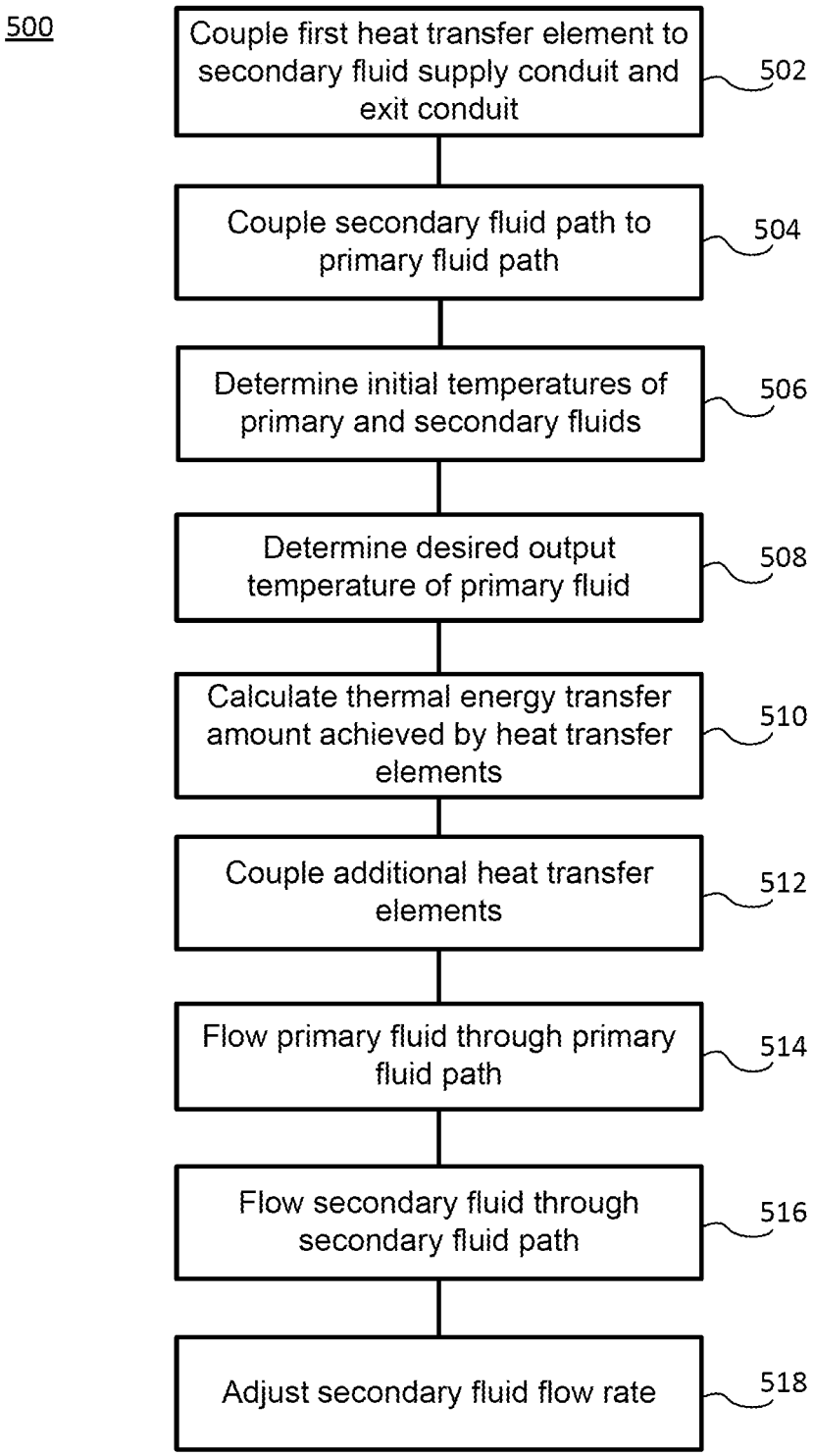
FIG. 5 illustrates a method for making and operating a heat exchanger having a heat transfer element, in accordance with various embodiments.

With combined reference to FIGS. 4 and 5, method 500 illustrates a method for making and operating a heat exchanger 400, in accordance with various embodiments. In various embodiments, a first heat transfer element 450A may be coupled to secondary fluid supply conduit 221 and secondary fluid exit conduit 225 (step 502). The first heat transfer element 450A may be fluidly coupled to secondary fluid supply conduit 221 and secondary fluid exit conduit 225 such that secondary fluid 206 may flow therethrough. Secondary fluid supply conduit 221, secondary fluid exit conduit 225, and heat transfer element(s) 450 may be comprised in the secondary fluid path. At least a portion of the secondary fluid path may be coupled to a primary fluid path (step 504) comprising primary fluid conduit 210 enclosing primary cavity 214. The first heat transfer element 450A, and any other heat transfer elements 450 comprised in heat exchanger 400, may be disposed in primary cavity 214. In various embodiments, secondary fluid supply conduit 221 may be internal or external to primary fluid conduit 210 and/or primary cavity 214. In various embodiments, secondary fluid exit conduit 225 may be internal or external to primary fluid conduit 210 and/or primary cavity 214.

A user of heat exchanger 400 may desire a certain amount of thermal energy to be transferred to or from primary fluid 202. Therefore, the initial temperature of primary fluid 202 may be determined (step 506) (i.e., the temperature at which primary fluid 202 enters primary cavity 214 before contacting any heat transfer elements 450). The desired final temperature of primary fluid 202 may be determined (step 508) (i.e., the desired temperature of primary fluid 202 after flowing through primary cavity 214 and participating in heat transfer events with heat transfer elements 450). Additionally, a flow rate for primary fluid 202 through primary cavity 214 may be determined. In order to achieve the desired output temperature of primary fluid 202, an initial temperature of secondary fluid 206 may be determined (step 506) (i.e., the temperature of secondary fluid 206 flowing through secondary fluid supply conduit 221 and entering heat transfer elements 450, before participating in a heat transfer event with primary fluid 202 through secondary outer shell 452 of a heat transfer element 450). Additionally, a flow rate of secondary fluid 206 flowing through the first heat transfer element 450A may be determined or set (e.g., by adjusting flow regulator 255 coupled to heat transfer element inlet 453 of the first heat transfer element 450A). In response to determining initial temperatures determined for primary fluid 202 and secondary fluid 206, the flow rate of primary fluid 202 through primary cavity 214, and the flow rate of secondary fluid 206 through the first heat transfer element 450A, the thermal energy transfer between primary fluid 202 and secondary fluid 206 achieved by the first heat transfer element 450A may be calculated (step 510).

Using the calculated thermal energy transfer achieved by preceding heat transfer element 450A, the thermal energy transfer between primary fluid 202 and secondary fluid 206 achieved by any subsequent heat transfer element 450 may be calculated (e.g., the second heat transfer element 450B). Therefore, the number of heat transfer elements 450 necessary to achieve the desired final temperature of primary fluid 202 may be determined. In response, the additional heat transfer elements 450 may be coupled to secondary fluid supply conduit 221 and secondary fluid exit conduit 225 (step 512) and disposed within primary cavity 214. For example, heat transfer elements 450 may be coupled (i.e., added) to or decoupled (i.e., removed) from secondary fluid supply conduit 221 and secondary fluid exit conduit 225 through the opening in primary outer shell 212 with hatch 216 open. That is, in various embodiments, hatch 216 and the opening in primary outer shell 212 may allow access to primary cavity 214 to facilitate addition or removal of heat transfer elements to a heat exchanger based on the desired heat transfer. In various embodiments, heat exchanger 400 may be altered such that primary cavity 214 ends after the necessary heat transfer elements 450, such that primary fluid 202 will be directed out of primary cavity 214 or away from further heat transfer elements 450 after contacting the necessary heat transfer elements 450.

To achieve different amounts of thermal energy transfers via different heat transfer elements, in various embodiments, the size and/or shape of a heat transfer element added or removed from a heat exchanger may have a certain size, shape, and/or design. For example, to have a greater effect on heat transfer, a heat transfer element added or removed may comprise a larger shape (e.g., occupying more surface area of the primary cavity such that more of the primary fluid contacts such a heat transfer element), a design creating more surface area of the respective heat transfer element such that more of the primary fluid contacts such heat transfer element surface area, a secondary fluid conduit having a greater area (to allow for secondary fluid flow), and/or the like. To achieve a lesser effect on heat transfer, a heat transfer element added or removed may comprise characteristics opposite of those described above. Accordingly, depending on the desired thermal energy transfer result, a heat exchanger may comprise heat transfer elements of different sizes, shapes, and/or designs to achieve such a desired result.

To carry out the transfer of thermal energy between primary fluid 202 and secondary fluid 206, primary fluid 202 may flow through the primary fluid path (e.g., primary cavity 214) (step 514) and secondary fluid 206 may flow through the secondary fluid path (step 516). Secondary fluid 206 may flow through secondary fluid supply conduit 221, and different portions of secondary fluid 206 may flow into heat transfer elements 450. That is, the same portion of secondary fluid 206 may not flow through multiple heat transfer elements 450. The portions of secondary fluid 206 in the respective heat transfer elements 450 may exit heat transfer elements 450 and flow into and through secondary fluid exit conduit 225. The portions of secondary fluid 206 within heat transfer elements 450 may thermally interact with primary fluid 202 contacting the respective heat transfer element 450. Thermal energy may be exchanged between primary fluid 202 and secondary fluid 206 through secondary outer shell 452, which may separate primary fluid 202 and secondary fluid 206. Therefore, in response to the thermal energy exchange, after contacting a heat transfer element 450, primary fluid 202 may be warmer or colder, and after flowing through a heat transfer element 450, the respective portion of secondary fluid 206 may be colder or warmer.

In various embodiments, the thermal energy exchange achieved by a heat transfer element 450 may be changed by adjusting the flow rate of secondary fluid 206 therethrough. The flow rate through a heat transfer element 450 may be adjusted (step 518) by adjusting the flow regulator 255 coupled to the heat transfer element inlet 453. In various embodiments, the thermal energy exchange achieved by a heat transfer element 450 may be changed by adjusting the temperature of secondary fluid 206 as it enters a heat exchanger element, such as by adjusting the temperature of a temperature change device 257 coupled to a heat element inlet 253. Such an adjustment may change only the temperature of the portion of secondary fluid 206 entering the respective heat element 450 coupled to the adjusted temperature change device 257. Therefore, the thermal energy exchanged achieved by a heat transfer element 450 may be modulated to fit application needs.

The heat exchanger systems and methods described herein allow a user to incrementally add or remove thermal energy from a fluid by contacting the fluid with a series of heat transfer elements. The thermal energy exchange achieved by each heat transfer element may be calculated and/or adjusted, and therefore, thermal energy addition or removal from a fluid may be more calculated and precise than other heat exchanger systems.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A heat exchanger, comprising:

a primary fluid path comprising a continuous primary outer shell enclosing a primary cavity through which a primary fluid can flow; and a secondary fluid path coupled to the primary fluid path and comprising a secondary fluid supply conduit, a secondary fluid exit conduit, and multiple heat transfer elements coupled fluidly between the secondary fluid supply conduit and the secondary fluid exit conduit and disposed in series in the primary cavity, wherein the secondary fluid path is configured such that a secondary fluid can flow through the secondary fluid supply conduit, the multiple heat transfer elements, and the secondary fluid exit conduit, which are in fluid communication with one another;

wherein the multiple heat transfer elements are disposed in the primary cavity such that the primary fluid contacts the multiple heat transfer elements, wherein a heat exchange amount resulting from the primary fluid contacting each of the multiple heat transfer elements can be calculated for each of the multiple heat transfer elements, wherein a needed number of the multiple heat transfer elements coupled fluidly between the secondary fluid supply conduit and the secondary fluid exit conduit and disposed in the primary cavity to achieve a desired output temperature for the primary fluid can be determined, and wherein the primary outer shell comprises an opening and a hatch disposed within the opening, wherein the hatch is configured to fluidly separate the primary cavity from a surrounding environment external to the primary cavity, wherein the hatch is removable to expose the opening causing the primary cavity to be in fluid communication with the surrounding environment, wherein the hatch and the opening have a size and a shape that are complementary to a size and shape of one or more of the multiple heat transfer elements, wherein the hatch is configured to allow addition or removal of one or more of the multiple heat transfer elements to or from the primary cavity to achieve the desired output temperature.

2. The heat exchanger of claim 1, wherein each heat transfer element of the multiple heat transfer elements comprises a flow regulator configured to regulate a secondary fluid flow rate through the respective heat transfer element.

3. The heat exchanger of claim 1, wherein a cross-sectional shape of each of the multiple heat transfer elements is complementary to a cross-sectional shape of the primary cavity, such that each of the multiple heat transfer elements occupies at least a portion of a cross-sectional area of the primary cavity.

4. The heat exchanger of claim 1, further comprising a plurality of flow regulators, wherein each of the plurality of flow regulators is coupled to the secondary fluid path upstream of a respective heat transfer element of the multiple heat transfer elements, wherein each flow regulator is configured to regulate a secondary fluid flow rate through the respective heat transfer element of the multiple heat transfer elements.

5. The heat exchanger of claim 4, wherein each flow regulator is coupled to a heat transfer element inlet of each of the multiple heat transfer elements, which is disposed between each of the multiple heat transfer elements and the secondary fluid supply conduit, such that the secondary fluid can flow from the secondary fluid supply conduit and into each of the multiple heat transfer elements through the respective heat transfer element inlet.

6. The heat exchanger of claim 1, wherein at least one of the multiple heat transfer elements comprises a temperature change device configured to change the temperature of the secondary fluid flowing through the least one of the multiple heat transfer elements.

7. The heat exchanger of claim 1, wherein at least one of the multiple heat transfer elements comprises a design including at least one of a circular shape, a conical shape, a frusto-conical shape, a teardrop shape, a spiral shape, or a web design.

8. The heat exchanger of claim 1, wherein the heat exchanger is able to operate with the multiple heat transfer elements positioned substantially horizontally relative to one another and with the multiple heat transfer elements positioned substantially vertically relative to one another.

9. The heat exchanger of claim 1, wherein the heat exchanger is able to operate with the primary fluid and the secondary fluid in parallel flow directions and with the primary and secondary fluid in opposite flow directions.

10. A heat exchanger, comprising:

a primary fluid path comprising a primary outer shell enclosing a primary cavity through which a primary fluid can flow; and a secondary fluid path coupled to the primary fluid path and comprising a secondary fluid supply conduit, a secondary fluid exit conduit, and multiple heat transfer elements coupled fluidly between the secondary fluid supply conduit and the secondary fluid exit conduit and disposed in series and adjacent to one another in the primary cavity, wherein the secondary fluid path is configured such that a secondary fluid can flow through the secondary fluid supply conduit, the multiple heat transfer elements, and the secondary fluid exit conduit, which are in fluid communication with one another;

wherein the multiple heat transfer elements are disposed in the primary cavity such that the primary fluid contacts the multiple heat transfer elements, wherein a heat exchange amount resulting from the primary fluid contacting each of the multiple heat transfer elements can be calculated for each of the multiple heat transfer elements, wherein a needed number of the multiple heat transfer elements coupled fluidly between the secondary fluid supply conduit and the secondary fluid exit conduit and disposed in the primary cavity to achieve a desired output temperature for the primary fluid can be determined, and wherein the primary outer shell comprises an opening and a hatch disposed within the opening, wherein the hatch is configured to fluidly separate the primary cavity from a surrounding environment external to the primary cavity, wherein the hatch is removable to expose the opening causing the primary cavity to be in fluid communication with the surrounding environment, wherein the hatch and the opening have a size and a shape that are complementary to a size and shape of one or more of the multiple heat transfer elements, wherein the hatch is configured to allow addition or removal of one or more of the multiple heat transfer elements to or from the primary cavity to achieve the desired output temperature.

* * * * *